US006386730B1

(12) United States Patent
Matthews

(10) Patent No.: US 6,386,730 B1
(45) Date of Patent: May 14, 2002

(54) DUAL REFLECTOR, RECHARGEABLE, AND CRASH-SECURED FLASHLIGHTS

(75) Inventor: John Wallace Matthews, Newport Beach, CA (US)

(73) Assignee: Surefire, LLC, Fountain Valley, CA (US)

( * ) Notice: Subject to any disclaimer, the term of this patent is extended or adjusted under 35 U.S.C. 154(b) by 0 days.

(21) Appl. No.: 09/556,490

(22) Filed: Apr. 21, 2000

(51) Int. Cl.[7] ..... F21L 7/00
(52) U.S. Cl. ..... 362/184; 362/183; 362/202
(58) Field of Search ..... 362/184, 183, 362/196, 197, 202, 208, 205, 230, 231, 241, 247; 320/114, 115, 113

(56) References Cited

U.S. PATENT DOCUMENTS

| | | | | |
|---|---|---|---|---|
| 1,423,911 A | | 7/1922 | Cardwell | |
| 1,448,352 A | | 3/1923 | Barany et al. | |
| 2,190,035 A | | 2/1940 | Loungway | |
| 3,596,078 A | | 7/1971 | Owens | |
| 4,249,234 A | | 2/1981 | Park et al. | |
| 4,677,533 A | | 6/1987 | McDermott et al. | |
| 4,947,291 A | | 8/1990 | McDermott | |
| 4,963,798 A | | 10/1990 | McDermott | |
| 4,985,813 A | | 1/1991 | Putman | |
| 5,081,568 A | | 1/1992 | Dong et al. | |
| 5,161,879 A | | 11/1992 | McDermott | |
| 5,174,648 A | | 12/1992 | Clary et al. | |
| 5,359,779 A | | 11/1994 | Polk et al. | |
| 5,629,105 A | * | 5/1997 | Matthews | 362/183 |
| 5,685,637 A | | 11/1997 | Chapman et al. | |
| 5,722,755 A | | 3/1998 | Slape | |
| 5,871,272 A | * | 2/1999 | Sharrah et al. | 362/184 |
| 5,984,494 A | | 11/1999 | Chapman et al. | |
| 6,019,482 A | | 2/2000 | Everett | |
| 6,095,661 A | | 8/2000 | Lebens et al. | |
| 6,183,105 B1 | * | 2/2001 | Parker | 362/183 |

OTHER PUBLICATIONS

Photograph dated Apr. 9, 2000 of emergency flashlights on wall of passenger aircraft with straps retaining them in place against removal. (note text of paragraph bridging pp. 18 and 19 of the above–identified patent application, and particularly comment on retention straps in line 4 on p. 19).

Photograph dated May 19, 2000 of search light on top of police car having one tubular halogen light extending across the inside of two parabolic reflectors.

* cited by examiner

*Primary Examiner*—Sandra O'Shea
*Assistant Examiner*—Bao Q. Truong
(74) *Attorney, Agent, or Firm*—David Weiss

(57) ABSTRACT

A flashlight having a flashlight head with two merged yet independent lamp/reflector systems, the head including a common reflector structure having two reflectors of differing light projecting characteristics, the two reflectors arranged side by side with a common boundary across part of the common reflector structure. A flashlight holder and battery charger includes interacting surfaces on the flashlight and the holder that permit insertion of the flashlight into the holder only when the flashlight is in a predetermined position relative to the holder, require that the flashlight be manually moved or rotated in a predetermined direction after insertion for locking the flashlight in the holder and for permitting battery charging only when the flashlight's lamps are disconnected from the batteries, and require that the flashlight be manually moved or rotated in the opposite direction for permitting removal of the flashlight from the holder. A sequential switching arrangement on the flashlight changes the light output of the dual lamp flashlight according to the distance by which a push-button on the flashlight is depressed.

50 Claims, 7 Drawing Sheets

DUAL REFLECTOR, RECHARGEABLE, AND CRASH-SECURED FLASHLIGHTS

FIELD OF INVENTION

The subject invention relates to battery powered appliances, including electric light source systems and flashlights.

BACKGROUND

Even though flashlights and similar systems exist in a very large number of different types and kinds, there still were needs which had not been met, as this disclosure will show by reference to prior-art systems.

SUMMARY OF THE INVENTION

The subject invention and its embodiments provide various improvements and innovations meeting and satisfying several of such needs.

The invention resides in a flashlight having two battery-powered and individually switched electric light sources, and, more specifically, resides in the improvement comprising, in combination, a common reflector structure for such two electric light sources including a first reflector having a first light-projecting characteristic for a first one of such two electric light sources, and a second reflector having for the second of such two electric light sources a second light-projecting characteristic different from the first light-projecting characteristic; such first and second reflectors arranged side by side and having a common boundary across part of such common reflector structure.

The invention also resides in a flashlight having a switched electric light source, and, more specifically, resides in the improvement comprising, in combination, a battery for such electric light source having a positive terminal and a negative terminal, a housing for such battery, a positive battery charging current receiving terminal connected to the positive terminal and a negative battery charging current receiving terminal connected to the negative terminal in such housing, a holder for such housing, battery charging circuitry having in such holder a positive battery charging current supply terminal corresponding to the positive battery charging current receiving terminal, and a negative battery charging current supply terminal corresponding to the negative battery charging current receiving terminal, and interacting housing and holder features on the housing and the holder enabling insertion of such housing into the holder only for connection of the positive battery charging current receiving terminal to the positive battery charging current supply terminal and connection of the negative battery charging current receiving terminal to the negative battery charging current supply terminal.

The invention also resides in a flashlight having two battery-powered and individually switched electric light sources, and, more specifically, resides in the improvement comprising, in combination, a first electric battery for a first one of such two electric light sources, a second electric battery for the second of such two electric light sources, a first switching device between such first electric battery and the first electric light source, a second switching device between the second electric battery and the second electric light source, and a sequential actuator coupled to such first and second switching devices; such first electric light source having a power rating that is a fraction of a power rating of the second electric light source.

The invention resides also in a flashlight receivable in a flashlight holder, and, more specifically, resides in the improvement comprising, in combination, a flashlight-in-holder interlock having interlocking features on the flashlight and its holder; such interlock being manually releasable for removal of the flashlight from its holder without tools or fracture of parts, and such interlock retaining the flashlight in its holder against forces of acceleration in calamities.

The invention resides also in combinations of such features.

BRIEF DESCRIPTION OF THE DRAWINGS

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

MODES OF CARRYING OUT THE INVENTION

Figure 1:
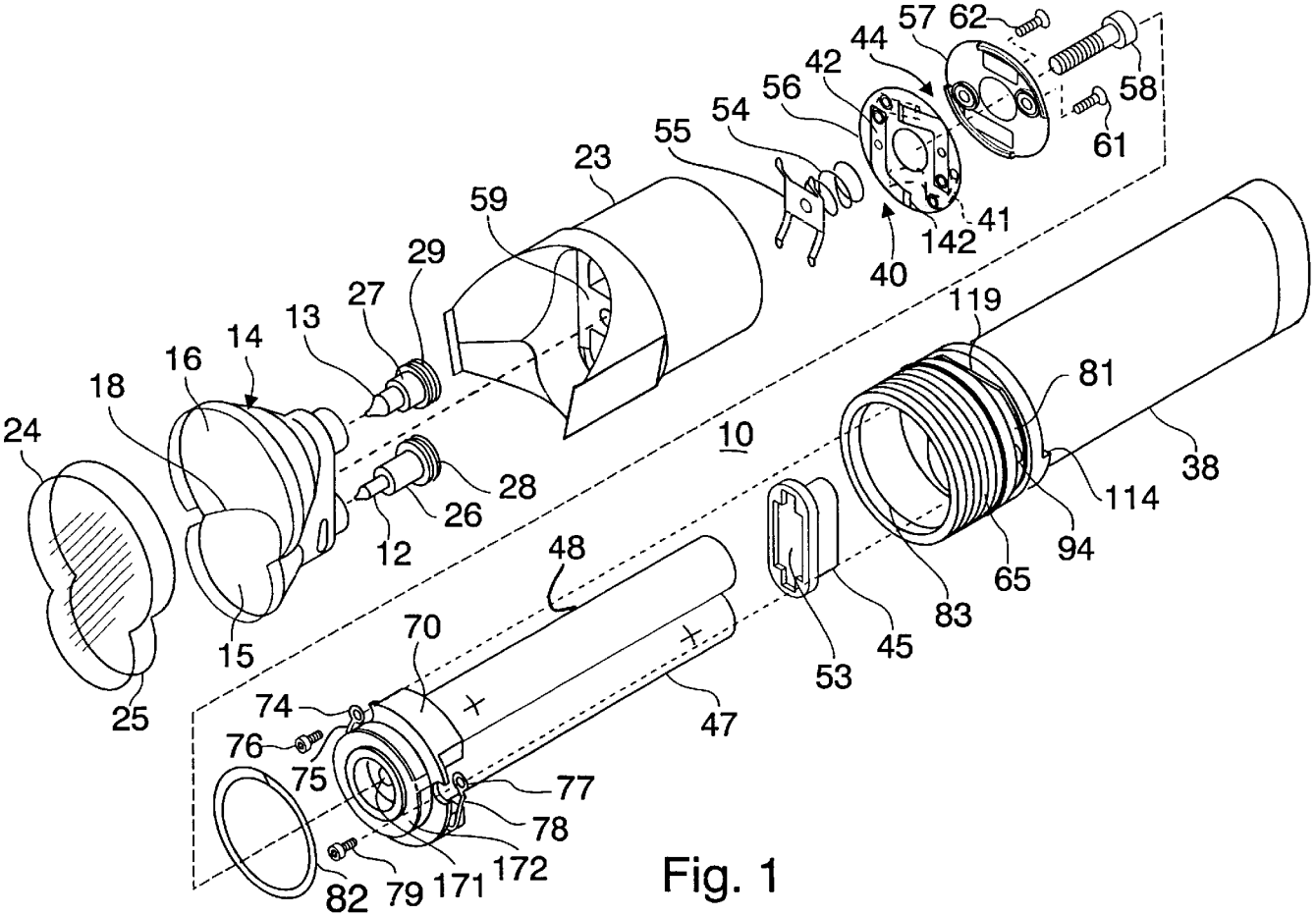
FIG. 1 is an exploded perspective view of a flashlight according to a preferred embodiment of the invention.

The drawings show various flashlights and flashlight systems according to different and related aspects and embodiments of the invention.

FIGS. 1 to 5, 12 to 13 show a flashlight 10 or 100 having two battery-powered and individually switched electric light sources 12 and 13. In the drawings, these light sources are shown within light bulbs, but the invention is not limited to a particular type or kind of electric light source.

A common reflector structure 14 for the two electric light sources include a first reflector 15 having a broad-beam or other first light-projecting characteristic for a first one of the two electric light sources, and a second reflector 16 having for the second of the two electric light sources a narrow-beam or other second light-projecting characteristic different from the first light-projecting characteristic. By way of example, the second reflector 16 has a larger diameter than the first reflector 15 in the illustrated embodiment of the invention.

According to a preferred embodiment of the invention, the first and second reflectors 15 and 16 are arranged side by side and have a common boundary 18 across part of the common reflector structure 14, such as seen in FIGS. 1 to 4. Such reflector structure may, but need not necessarily be, the same in the embodiment of FIGS. 12 and 13 as is so shown therein.

Preferably, the first and second reflectors 15 and 16 do not just touch each other at a common tangent, but have lateral truncations at their common boundary, such as seen at 18 in FIGS. 1 to 4. Put differently, the common boundary 18 between reflectors 15 and 16 is offset inwardly from a plane through the front end of the common reflector structure 14, such as a plane occupied by a lens or other transparent protective plate 24 or by its sealing O-ring 25 for that matter.

Figure 2:
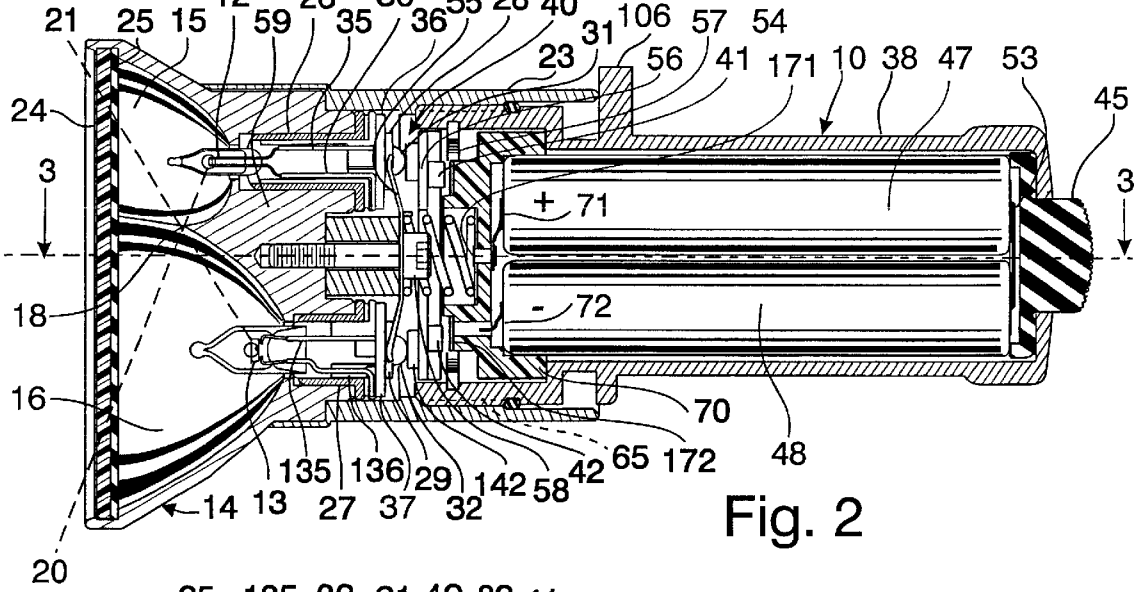
FIG. 2 is a longitudinal section of the flashlight shown in FIG. 1, but in an assembled state.

As demonstrated with the aid of a dotted line 20 in FIG. 2, the boundary 18 across part of the common reflector structure 14 is a shield for the second reflector 16 against light from the first electric light source 12, or vice versa, such as demonstrated by a second dotted line 21. Preferably, such boundary 18 across part of the common reflector structure 14 is a shield for either of the first and second reflectors 15 and 16 against light from either of the second and first electric light sources 13 and 12, respectively. In this manner, the currently disclosed embodiment of the invention prevents light from either source 12 and 13 from creating an undesirable effect in the beam or light output of the other light source.

Figure 3:
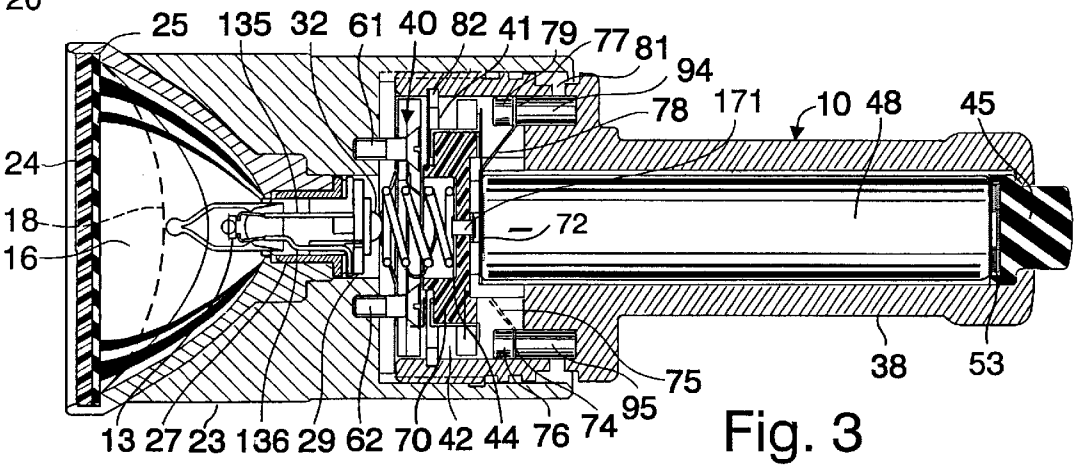
FIG. 3 is a section taken on the line 3—3 in FIG. 2.
Figure 12:
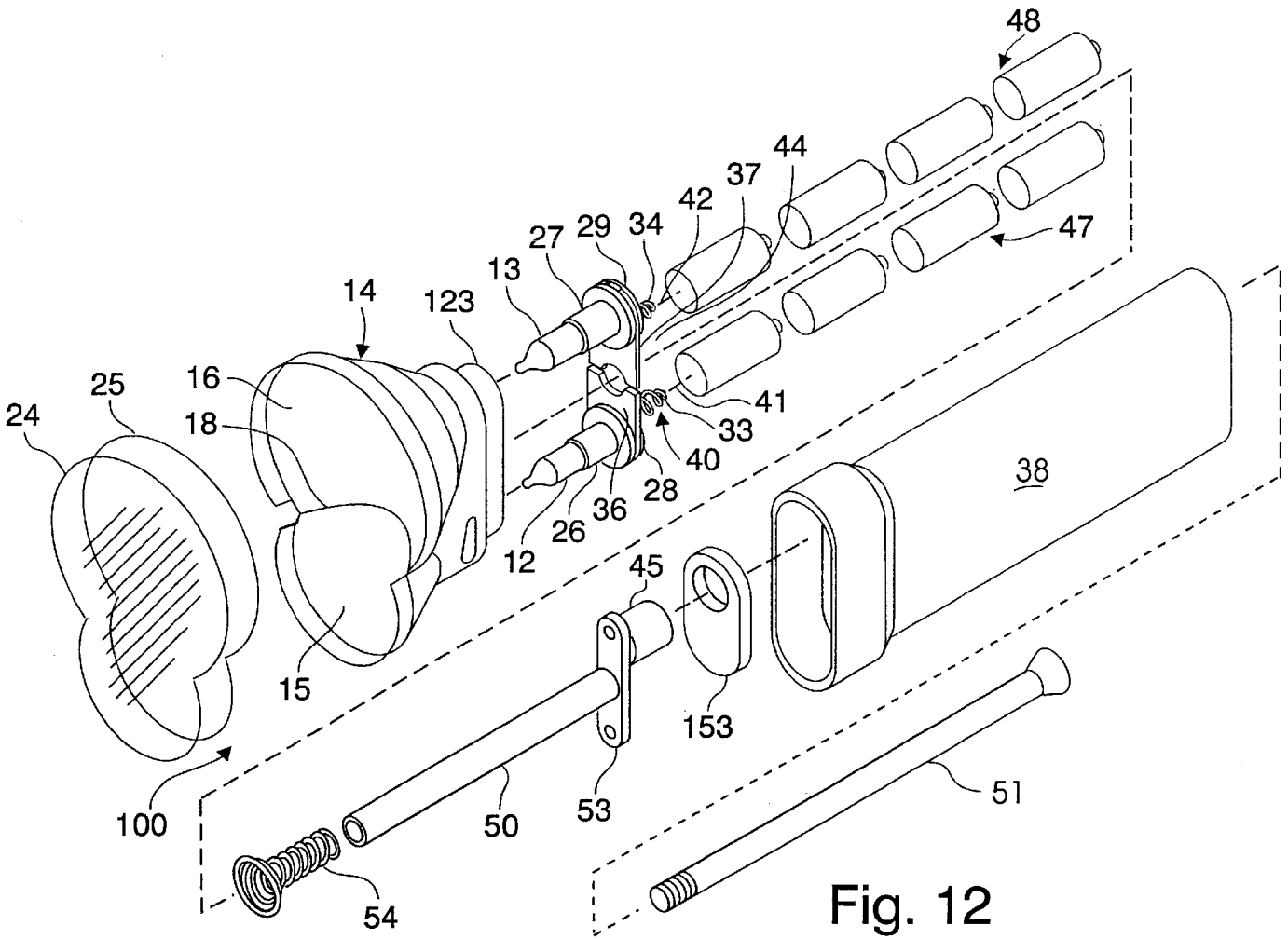
FIG. 12 is an exploded view of a flashlight according to a related embodiment of the invention.
Figure 13:
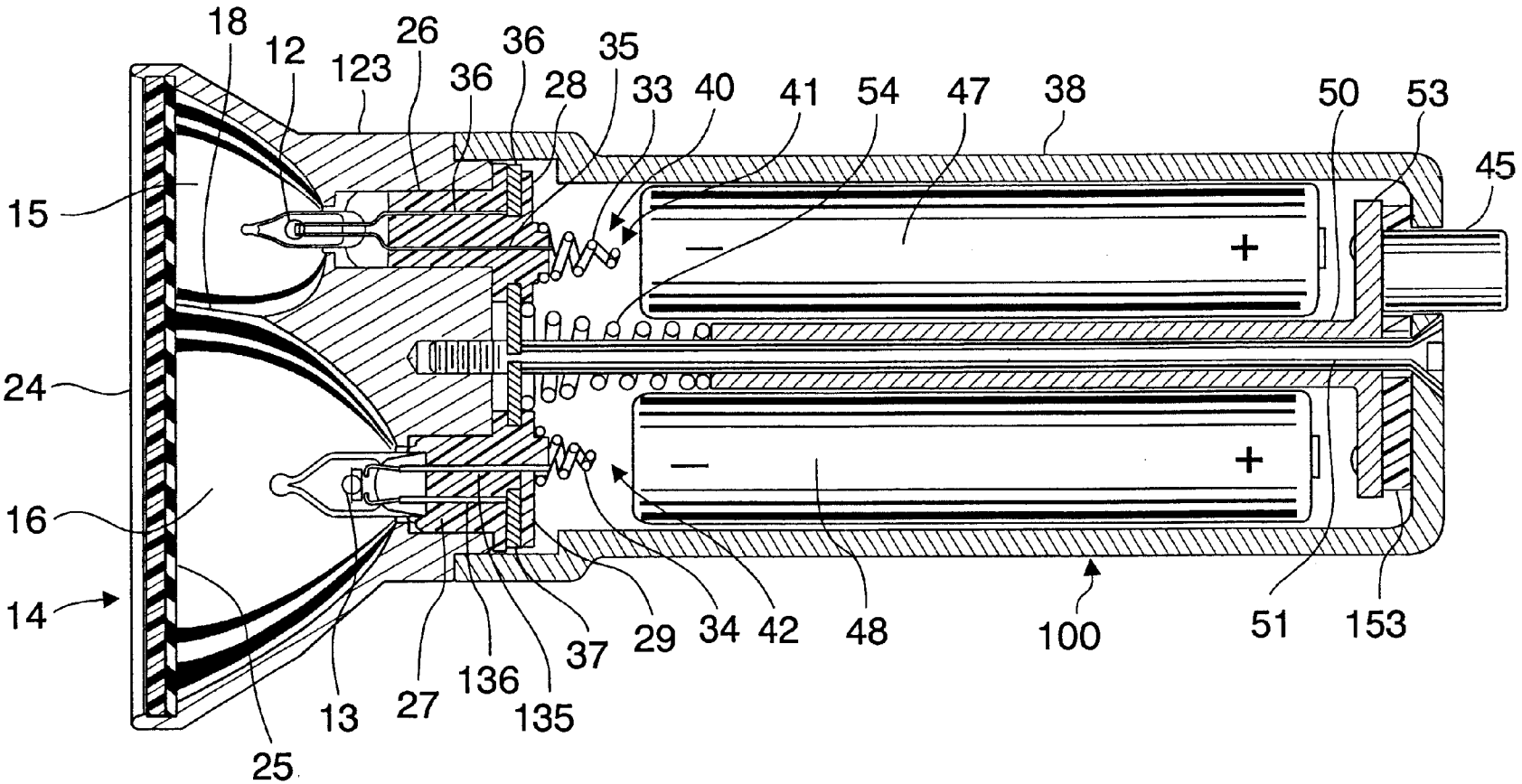
FIG. 13 is a longitudinal section though a body part of the flashlight shown in FIG. 12, but in an assembled state and with only one pair of batteries.

The common reflector structure 14 with first and second reflectors 15 and 16 and first and second light sources 12 and 13 may be incorporated in a lamp housing or lamp assembly 23 as seen in FIGS. 1 to 5 and 8, or 123 as shown in FIGS. 12 and 13. Such assembly may include the lens or other protective plate of transparent material 24 that may, for instance, be shaped in the form of an outline of the common reflector structure 14 with first and second reflectors 15 and 16 so as to fit into the front end of that common reflector structure. A similarly shaped O-ring 25 may be disposed between that transparent protective plate and that front end of the common reflector structure, such as for sealing purposes. As seen in FIGS. 2 and 3, the transparent protective plate 24 may be press fit into that front end of the common reflector structure 14, in which case the light sources 12 and 13 are preferably inserted and removed from the lamp housing or lamp assembly 23 through the rear of the common reflector structure 14.

To this end and in general, the first and second light sources may be mounted in first and second sockets 26 and 27 having electrically insulating terminal mounting end plates 28 and 29 for mounting, for instance, individual light source terminals 31 and 32.

Such light source terminals 31 and 32 may, for instance, include or be backed up by terminal springs 33 and 34, such as shown in FIGS. 12 and 13 as being mounted on the electrically insulating terminal mounting end plates 28 and 29, respectively. Each light source 12 and 13 preferably has a pair of terminal wires 35 and 36 and 135 and 136, respectively, such as seen in FIGS. 2, 3 and 13, with one terminal wire of each pair being connected to the central terminal 31 or 32 or 33 or 34 of that light source, and the other terminal wire of that pair being somehow connected to a common battery terminal, sometimes called "ground", such as through a battery housing 38 if it is electrically conductive or through some other common conductor.

In this respect, FIGS. 2, 3, 12 and 13 show the other terminal wire 36 and 136 of each pair connected, respectively, to second terminals 36 and 37 of light sources 12 and 13, such as for connection to batteries as more fully disclosed below.

Within the scope of the invention, the first and second light sources 12 and 13 may be energized individually, alternatively or jointly. According to an embodiment of the invention, the flashlight 10 or 100 has a sequential switching arrangement 40 for the first and second electric light sources.

In this respect and in general, there may be a first switching device 41 for the first electric light source 12, and a second switching device 42 for the second electric light source 13. By way of example, FIGS. 1 and 2 show the switch 42 from both sides of an electrically insulating support plate or disk 56 which hides the switch 41 from view. However, as shown for the switch 42 in FIGS. 1 and 2, that switch is spaced from an annular terminal 172 and has a portion 142 in contact with the central terminal 32 of the light source 13. The same kind of arrangement may be provided for the switch 41 and light source 12.

Within the scope of the invention, such first and second switching devices may be individually actuated, such as by manual operation by the user of the flashlight. However, according to a preferred embodiment of the invention, a sequential actuator 44 is coupled to the first and second switching devices 41 and 42.

In the embodiments of FIGS. 1 to 5 and 12 and 13, such sequential actuator 44 includes a push-button 45 which may, for instance, be positioned at the tailend of the flashlight 10 or 100.

Manual switch actuating power by a user of the flashlight may be received by the push-button 45 and transmitted via batteries 47 and 48 or otherwise to the switching devices 41 and 42. In this respect, switching devices 41 and 42 may have differently spaced switching contacts, so that the switching device 41 closes before the switching device 42 when the tailend push-button 45 is pushed into the flashlight housing 38. In this manner, the first light source 12 may, for instance, be energized to light before the second light source 13. Therefore, the first switching device 41 may be closed and the first light source 12 in our example may thereby be energized and lit by depression of the tailend push-button 45 for a first distance into the flashlight body 38, and may thereafter be deenergized and extinguished without the second light source 13 being ever lit during or after that energization and deenergization cycle of the first light source. By way of example, the first light source 12 may thus be temporarily lit in the first reflector 15 for closeup work, such as for the reading of a map, the inspection of a document, or the writing of a note or even for the illumination of a nearby object, person or scene.

On the other hand, if lighting at a distance is or becomes desirable, then the user of the flashlight in our example would push in the tailend push-button 45 for a farther second distance into the flashlight body 38, so as to close the second switch 42, whereby the second light source 13 is energized and lit in the second reflector 16, such as for generation of a far-reaching light beam.

Within the scope of the invention, the sequential switching arrangement can be such that the first switch 41 is opened and the first light source 12 is thereby deenergized, before or while the second switch 42 is closed and the second light source 14 is thereby energized. However, because of the above mentioned shielding of the second reflector by the height of the common reflector boundary 18 from light of the first light source 12, such as demonstrated with the aid of the dotted line 20 in FIG. 2, it is permissible to leave the first light source 12 energized during energization of the second light source 13. In practice, this considerably simplifies the switching arrangement 40 for sequential switching.

The same applies to the embodiment shown in FIGS. 12 and 13 where springs 33 and 34 are differently spaced from their respective battery terminals, as best seen in FIG. 13.

Within the scope of the invention, the same battery may be used for both light sources 12 and 13. However, a sophisticated flashlight design recognizes that different light sources have different needs. For instance, if the first light source 12 is, for instance, for low-level closeup work, while the second light source 13 is for powerful long-range beaming, then it would be better to have a first electric battery 47 for the first electric light source 12, and a second electric battery 48 for the second electric light source 13. In practice, such first and second batteries 47 and 48 may have different characteristics or even may be of different types or kinds. As shown by way of example in FIG. 12, but equally applicable to other embodiments, each battery may be composed of several cells for instance.

In the embodiments of the invention as seen in FIGS. 1 to 3, 12 and 13, the first switching device 41 is between the first electric battery 47 and the first electric light source 12, and the second switching device 42 is between the second electric battery 48 and the second electric light source 13. Again, the sequential actuator 44 may be coupled to such first and second switching devices 41 and 42. According to a refinement, the sequential actuator is coupled to the first switching device 41 through the first electric battery 47 and to the second switching device 42 through the second electric battery 48. In that case, the tailend push-button 45 may sequentially actuate the first and second switching devices 41 and 42 by pushing the batteries 47 and 48 toward the switching devices 41 and 42 when the user of the flashlight gradually pushes such tailend push-button into the flashlight body 38.

A common electric conductor structure may extend from the first and second electric light sources 12 and 13 to the tailend poles of the batteries 47 and 48 opposite the poles at switches 41 and 42. A familiar common electric conductor structure of this type, as already indicated above, includes an electrically conductive flashlight body at 38 or at least an electrically conductive strip along such flashlight body, especially if the flashlight is made of electrically insulating material.

According to an embodiment of the invention, a common electric conductor structure, such as seen at 50 in FIGS. 12 and 13, extends from the first and second electric light sources 12 and 13 or from their terminals 36 and 37 through the sequential actuator to the first and second electric batteries 47 and 48. Such common electric conductor may be biased by a spring 54 and arranged on a mounting rod 51 which may retain the lamp housing 123 in the battery housing 38. The common conductor 50 has a common battery contact plate 53 which may have a backup washer 153 and which is combined with the tailend push-button 45 so as to conduct electric power from either of the batteries 47 and 48 to corresponding return leads of the light sources or in order to interconnect such batteries in parallel or in series, depending on the flashlight design and depending on the design of applied battery chargers. Such a common contact plate 53 is also incorporated in the tailend push-button 45 in the embodiment of FIGS. 1 to 3, for instance.

The sequential switch actuator 44 may include a common bias spring 54 such as seen in FIGS. 1 to 3, 12 and 13, for biasing the individual switches 41 and 42 to their normally open position. Switches 41 and 42 may be mounted on a circuit board 56 protected by a cover 57. Such assembly of switching parts may be mounted at the lamp housing or lamp assembly 23 with the aid of a bolt 58 threaded into a bracket 59, and screws 61 and 62 interconnecting the circuit board 56 and cover 57. The tailend push-button 45 is biased to an outward rest position, such as by the spring assembly 54 in the embodiment of FIGS. 1 to 3, 12 and 13.

A resilient bracket 55 connects corresponding outer terminals 36 and 37 of the light sources 13 and 14 to one battery pole, such as the terminal 71 of battery 47, via screw 58, spring 54 and central terminal 171.

The lamp housing or lamp assembly 23 may be threaded or otherwise connected to the flashlight body or battery housing 38, such as with the aid of matching threads, one of which is seen at 65 in FIGS. 1 and 2, or with the aid of a screw 51 such as shown in FIGS. 12 and 13.

An aspect or embodiment of the subject invention extends to electrical battery charging circuitry connectable directly to the battery or batteries in the flashlight, as will now be disclosed particularly with the aid of FIGS. 1 and 6 to 11. In this respect, FIGS. 1, 2 and 3 show a battery charger adapter 70 by which electric battery charging circuitry is connectable directly to the first and second batteries 47 and 48 when the first and second electric light sources 12 and 13 are disconnected from such first and second batteries. In practice, this is very advantageous, as contrasted to prior-art solutions which charged flashlight batteries through a flashlight lamp filament. For one thing, elimination of the light source from the battery charging circuit avoids the type of limitations on the battery charging rate imposed by prior-art flashlight lamp filaments. Moreover, elimination of the light source from the battery charging circuit in effect prolongs the life of such light source, since it is not being traversed by electric current while the battery is being charged.

In general, prior-art solutions found the battery charging circuit to be considerably simplified, if the flashlight's light source is permitted to remain in the circuit while the battery was being charged, since it was easier to get to the battery from outside the flashlight through a flashlight switch to which the flashlight lamp was already connected, than to provide a separate charging path directly to the battery pole near the lamp housing, in circumvention of the flashlight lamp. In addition to the above mentioned disadvantages, that prior-art arrangement also precluded charging of batteries in flashlights which had LED's and other type of light sources that could not be transversed by a battery charging current.

The currently disclosed aspect of the invention avoids these prior-art dilemmas in an elegant way and permits charging all batteries in series at a charging voltage which is more than twice than the rated voltage of each light source 12 and 13.

In particular, the batteries 47 and 48 for the first and second electric light sources 12 and 13 as seen in FIGS. 2 and 3 have a common positive terminal 71 and a common negative terminal 72. Preferably, such opposite positive and negative terminals 71 and 72 are adjacent each other, such as seen in FIG. 2. This is accomplished by orienting the battery 47 polarity-wise in a first direction and the battery 48 polarity-wise in an opposite second direction, whereby, say, the negative pole of the battery 47 contacts the common battery contact plate 53 at the tailend push-button 45, while the positive pole of the battery 48 contacts such common battery contact plate. This results in a series connection of batteries 47 and 48 through the contact plate 53 whereby the positive pole of the battery 47 is at the front end of the battery housing 38 and the negative pole of the battery 48 is at that front end of the battery housing, both being in the vicinity of the lamp housing or lamp assembly 23.

The same arrangement may be used in other flashlight embodiments of the invention, such as in the embodiment of FIGS. 12 and 13, if use of the adapter 70 or other battery charging arrangement is desired in those embodiments as well. In such case, the orientation of battery poles would have to be reversed in one of the battery strings 47 and 48 in FIGS. 12 and 13 so that all batteries 47 and 48 are in series through the contact plate 53, as they are in FIGS. 1 to 3.

While such opposite poling of batteries 47 and 48 is not necessary for the operation of the first and second electric light sources 12 and 13 as herein disclosed, it is very advantageous for battery charging according to embodiments of the subject invention.

In this respect, the battery charger adapter 70 has a positive battery charging current receiving terminal 74 supplemented by a current-conducting lead 75 and a bolt 76 connected to the common positive batteries terminal 71, and a negative battery charging current receiving terminal 77 supplemented by a current-conducting lead 78 and a bolt 79 connected to the common negative batteries terminal 72 in the battery charge adapter 70 in battery housing 38. Bolts 79 and 76 are threaded in an electrically conducting manner into battery charging posts 94 and 95, respectively, in the battery housing at a lateral slot 81 in that housing, seen in FIGS. 3 and 8. The adapter 70 may be retained in the front end of the flashlight or battery housing 38 by a resilient retaining ring 82 which snaps into a corresponding groove 83 seen in FIG. 1.

As seen in FIGS. 1 and 2, the adapter 70 may carry a central terminal 171 connected to the common positive terminal 71 and an annular terminal 172 connected to the common negative terminal 72 of batteries 71 and 72. Switches 41 and 42 of light sources 12 and 13 include blades that are contacted in sequence by that annular terminal 172 as the user pushes the tailend switch 45 and thereby the batteries 71 and 72 inwardly toward the lamp housing 23. Alternative sequential switches as known in the flashlight art and other electrical apparatus may, of course, be employed within the scope of the invention.

FIGS. 6 to 11 show a mount or holder 90 for the flashlight 10 or flashlight housing 38. That flashlight mount or holder 90 may house a symbolically illustrated battery charging power supply 91 seen in FIG. 8 with a circuit board 191 indicated also in the views of FIGS. 9 to 11 without a showing of the power supply 91 and of power supply leads that are conventional in such cases.

Such power supply by way of example may include conventional direct-current power supply components connected or connectable, for instance, to an automobile or other vehicle battery or to an alternating-current supply. In the latter case, a preferred embodiment would use the familiar A/C to D/C adapter that may be plugged into a wall outlet, for instance, in which case part of the symbolically illustrated battery charging power supply would be external of the holder 90.

Figure 6:
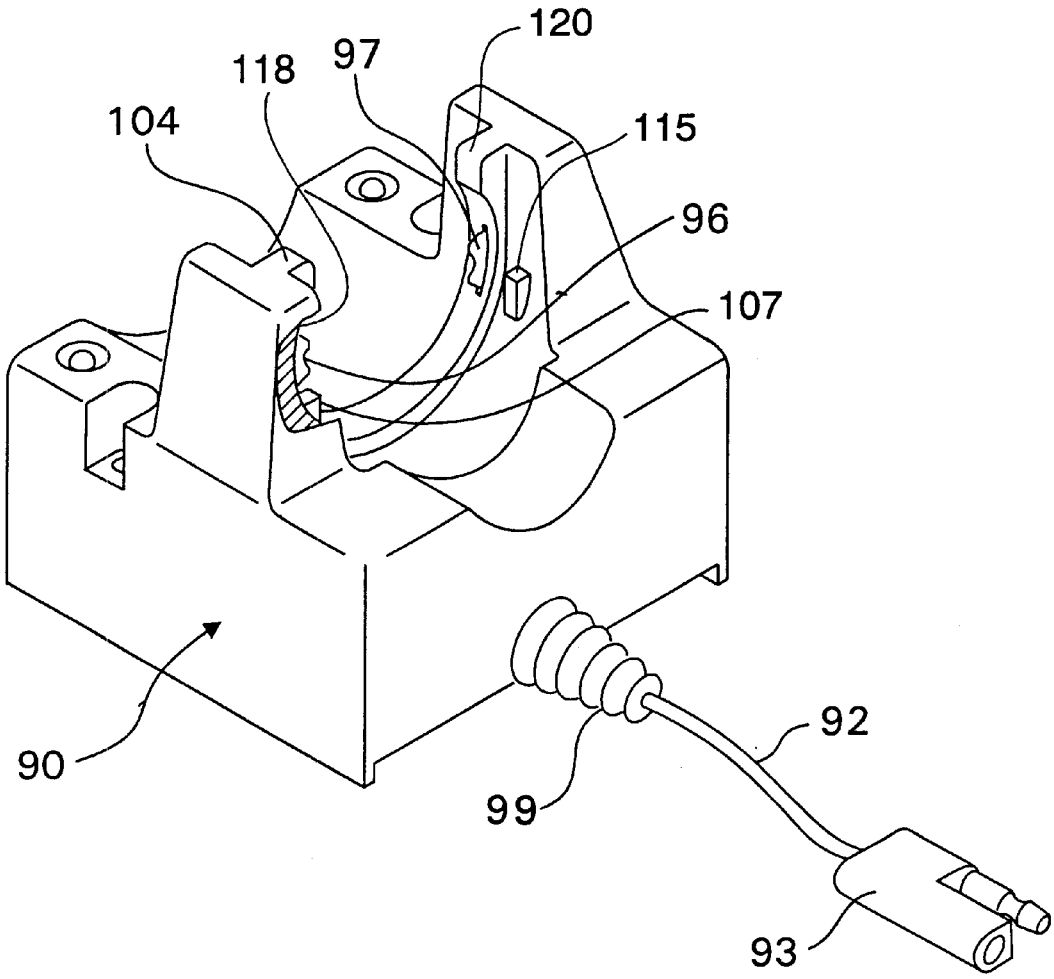
FIG. 6 is a perspective view of a battery charger flashlight holder of the flashlight shown in FIGS. 1 to 5 according to a related embodiment of the invention.

In this respect, FIG. 6 shows a cord 92 for supplying electric power to the power supply 91 or circuit board 191 via any suitable connector 93 and a cord bushing 99, for instance, at the flashlight holder 90.

The battery charging circuitry 91 or circuit board 191 has in that holder a positive battery charging current supply terminal 96 which corresponds to the positive battery charging current receiving terminal 74, and a negative battery charging current supply terminal 97 which corresponds to the negative battery charging current receiving terminal 77 in the battery charger adapter 70.

FIGS. 6 to 11 show interacting flashlight housing and holder features as more fully described below, for enabling insertion of the flashlight housing into the holder at battery charging slot 81 only for connection of the positive battery charging current receiving terminal 74 via post 95 to the positive battery charging current supply terminal 96 and connection of the negative battery charging current receiving terminal 77 via post 94 only to the negative battery charging current supply terminal 97.

As a special feature of the preferred embodiment illustrated in FIGS. 1 to 11, the interacting flashlight and holder features include features enabling insertion of the flashlight housing into that battery charging holder only when both first and second electric light sources 12 and 13 are disconnected from their batteries 47 and 48 so that there is no danger that battery charging current may reach any of these light sources. The flashlight 10 of FIGS. 1 to 5 in that embodiment accomplishes that feature with the switching arrangement 40 in which the switches 41 and 42 become disoperatively separated from their actuator 44. By way of example, such deactivation of the switching arrangement may be effected by unscrewing or otherwise translatorily moving the lamp housing 23 in a direction away from the flashlight body 38 for a sufficient distance 102 so as to remove the light source switches 41 and 42 from the reach of their actuator 44 or common terminal 172. In this respect, these light source switches preferably are mounted inside the lamp housing 23, such as with the aid of fasteners 61 and 62.

Figure 8:
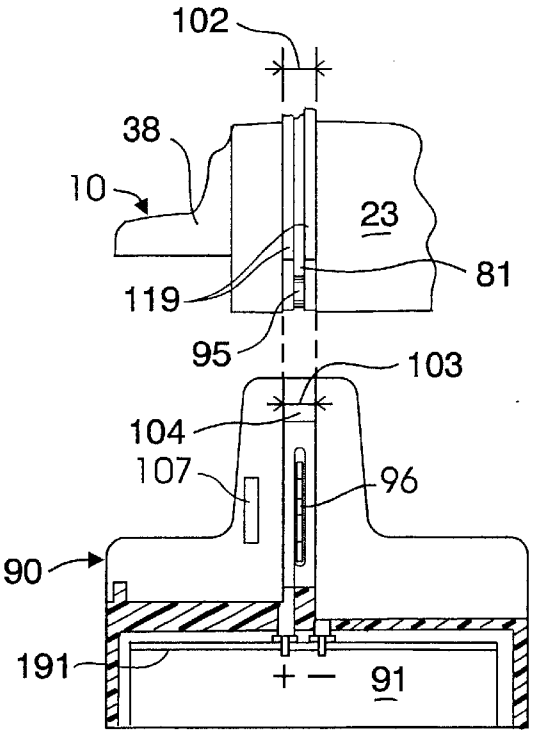
FIG. 8 is a section on the line 8—8 in FIG. 7 and also shows part of the flashlight of FIGS. 1 to 5 in conjunction with the battery charger flashlight holder of FIGS. 6 and 7.
Figure 4:
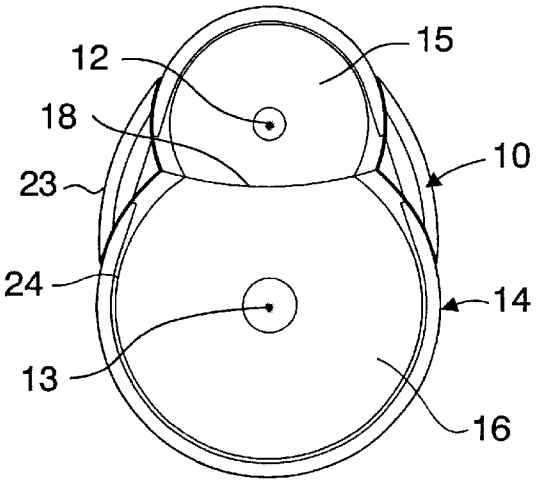
FIG. 4 is a frontal view of the lamp assembly of the flashlight shown in FIGS. 1 to 3.
Figure 5:
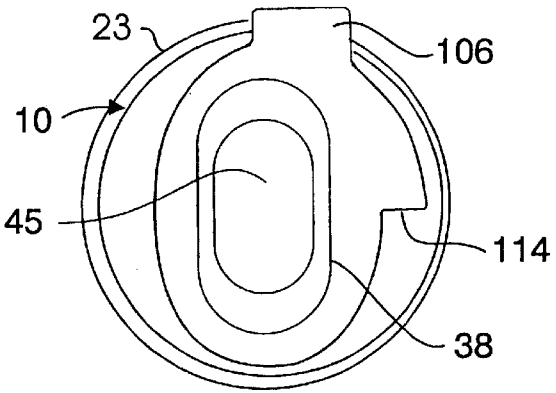
FIG. 5 is a rear view of the flashlight shown in FIGS. 1 to 4.

The light source-separating distance 102 is seen in FIG. 8 which also shows the corresponding thickness 103 of a flashlight insertion blocking member 104 which, as its name implies, effectively blocks insertion of the flashlight into its charging holder 90 as long as there is any danger that the light sources 12 and 13 could become connected to the power supply 91, such as via batteries 47 and 48 or battery terminals 71 and 72 and switches 41 and 42.

In other words, if the lamp housing 23 is not unscrewed or translatorily moved in a direction away from the flashlight body 38 for a distance 102 sufficient to preclude any inadvisedly intended or accidental connection of the light sources to the charging circuit 91, 191, 96, 97, etc., then the flashlight simply will not fit into the holder 90, as the blocking member 104 of the holder 90 will then block such insertion until the lamp housing 23 has been sufficiently unscrewed or translatorily moved in a direction away from the flashlight body 38 until both switches 41 and 42 have been disabled from connecting any current to any of the light sources 12 and 13. This also clears the lateral battery charging slot 81 for entry of the battery charging current supply terminals 96 and 97.

In this or any other manner within the scope of the invention, the flashlight is provided with a lamp module 23 including the light source or sources on the housing 38 for the battery or batteries and having a light source energization enabling position and a different light source energization inhibiting position, and the holder 90 has a lamp module energization enabling/inhibiting position sensor 104 adapted to inhibit insertion of that housing 38 into the holder when the lamp module is in its light source energization enabling position, such as shown by way of example in FIG. 8.

The features so far mentioned with respect to the charging arrangement are of course not limited to the illustrated embodiment, but extend to any flashlight having a switched electric light source (e.g. 12 and/or 13), a battery (e.g. 47 and/or 48) for such electric light source(s) having a positive terminal (e.g. 71) and a negative terminal (e.g. 72), a housing (e.g. 38) for such battery, a positive battery charging current receiving terminal (e.g. 74) connected to the positive battery terminal and a negative battery charging current receiving terminal (e.g. 77) connected to the negative battery terminal in that housing. A holder (e.g. 90) for that flashlight housing 38 at least partially houses battery charging circuitry 91, 191 having in that holder a positive battery charging current supply terminal 96 corresponding to the positive battery charging current receiving terminal (e.g. 74) and a negative battery charging current supply terminal (97) corresponding to the negative battery charging current receiving terminal (e.g. 77) in the flashlight.

The above mentioned interacting housing and holder features more fully described below for the flashlight housing and its holder also apply to a general type of flashlight with only one light source and as little as only one battery or single battery cell to enable insertion of the flashlight housing into its charging holder only for connection of the positive battery charging current receiving terminal to the positive battery charging current supply terminal of the charger 90 and connection of the negative battery charging current receiving terminal of the flashlight to the negative battery charging current supply terminal of that charger.

Preferably, the type of interacting housing and holder features herein mentioned also include for such general type of flashlight the features disclosed by reference to FIG. 8 for enabling insertion of the flashlight housing into its charger holder only when the flashlight's electric light source is disconnected from its battery.

The features preventing connection of the batteries 47 and 48 (or of a single battery or battery cell in simple flashlights) at reversed polarity (plus-to-minus and minus-to-plus) at the battery charging holder 90 are very important in practice, since batteries could explode or otherwise be damaged and the battery charger could suffer or cause a fire, if interconnection of battery charger and batteries at crossed polarities would accidentally occur.

To prevent such occurrence, the embodiment of FIGS. 1 to 11 equips the battery housing 38 with an asymmetrical protrusion 106 and the flashlight holder 90 with a corresponding stop 107 as the above mentioned interacting flashlight housing and flashlight holder features enabling insertion of that housing into that holder only for connection of the positive battery charging current receiving terminal 74 to the positive battery charging current supply terminal 96 and connection of the negative battery charging current receiving terminal 77 to the negative battery charging current supply terminal 97.

Figure 9:
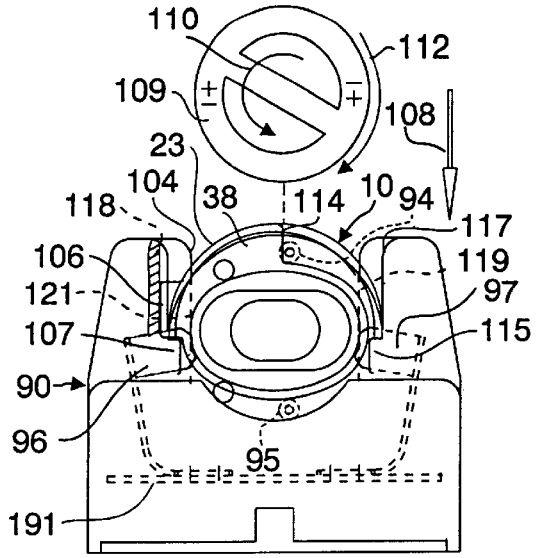
FIG. 9 is a view similar to FIG. 7, illustrating insertion of the flashlight of FIGS. 1 to 5 into the battery charger flashlight holder, supplemented by an international NO symbol illustrating permissible and impossible turns of the flashlight for proper battery charging operation.

An arrow 108 in FIG. 9 indicates insertion of the flashlight 10 into its holder 90, with lamp housing 23 and flashlight body 38 sufficiently separated for clearance of the flashlight insertion blocking member 104 described above with reference to FIG. 8 to prevent accidental connection of the light sources 12 and 13 to the battery charger 91.

In the flashlight insertion case illustrated in FIG. 9, the flashlight housing protrusion 106 abuts the stop 107 in the charger holder 90, thereby effectively preventing rotation of the flashlight body in the wrong direction. In particular, an international NO-symbol 109 over a curved arrow 110 in FIG. 9 illustrates prevention of any flashlight rotation that would result in connection of the flashlight batteries 47 and 48 to the charger 91 at crossed polarities which could damage both charger and batteries.

Figure 10:
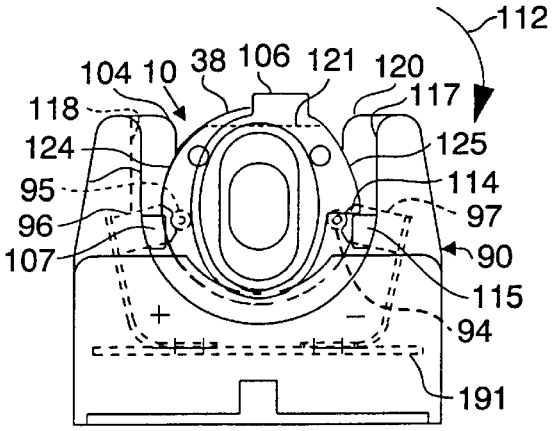
FIG. 10 is a view similar to FIG. 9 after one quarter turn of the flashlight for a battery charging operation.

Conversely, an oppositely proceeding curved arrow 112 in FIG. 9 indicates permissible flashlight rotation that will result in the correct connection of the positive battery charging current receiving terminal 74 to the positive battery charging current supply terminal 96 via battery charging post 95, and connection of the negative battery charging current receiving terminal 77 to the negative battery charging current supply terminal 97 via battery charging post 94 as in FIG. 10. In this respect, FIG. 10 shows the flashlight body after a quarter turn from the position shown in FIG. 9 for a battery charging operation.

A cam 114 on the flashlight body 38 abuts a second stop 115 in the flashlight charger holder 90 for accurate positioning of the battery charging posts 94 and 95 at the battery charging current supply terminals 97 and 96, respectively.

After completion of a battery charging operation, the flashlight body is rotated back one quarter turn in the direction of arrow 110 to the position shown in FIG. 9, whereupon the flashlight can be removed from its charger holder 90, such as seen in FIG. 8, and light sources 12 and 13 can be energized in sequence from the charged batteries 47 and 48, such as by screwing or translatorily moving the lamp housing 23 onto or on the flashlight body 38 to a position as seen in FIGS. 2 and 3 for the switching of the flashlight or light sources as described above, for example.

Figure 11:
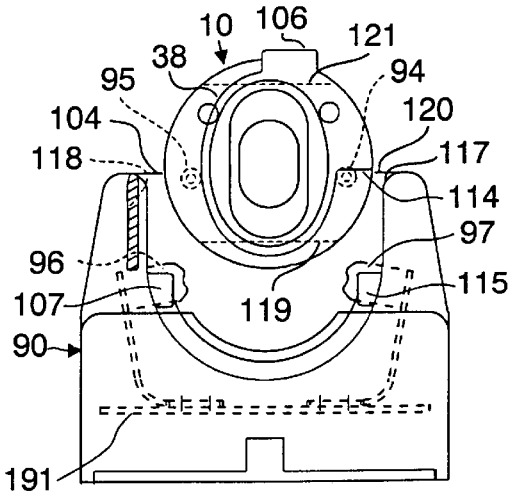
FIG. 11 is a view similar to FIG. 9, but illustrating another inhibition of flashlight insertion to prevent an improper battery charging operation.

FIG. 11 illustrates another inhibition of improper flashlight insertion. Unlike the permissible insertion illustrated in FIG. 9, FIG. 11 illustrates an attempt of a user to insert the flashlight the wrong way, such as some 90 to 180 degrees "out of phase" or out of turn, from the correct position shown in FIG. 9. In that case, adjacent flashlight housing portions run against portions 104 and 120 of the holder 90 which thus prevent wrongful insertion of the flashlight into the charger holder where flashlight batteries and the charger 91 would be interconnected at crossed polarities thereby exposing charger and batteries to damage.

As a further safeguard, if the user attempts to correct the situation by turning the flashlight from the position shown in FIG. 11 to the right, its protrusion 106 will run against the protrusion 117 of the charger holder 90, quite unlike the situation illustrated in FIG. 9 where one or more flats on the flashlight body 38 and/or in the charger holder 90 permit correct insertion of the flashlight body into its charger holder 90 for proper battery charging operation. By way of example, one such flat 118 in and at only one side of the charger holder 90 is shown in FIGS. 7 and 9 to 11 for accommodation of the correctly inserted flashlight into the charger holder 90.

Also by way of example, FIG. 1 shows one flat 119 and FIG. 8 shows part of a pair of such flats 119 that are capable of passing by a flashlight holder protrusion 120 when the flashlight is correctly inserted into that charger holder 90. One opposite flat or a pair of opposite flats 121 may also be provided on the flashlight body 38 to permit the flashlight to pass by an opposite flashlight holder protrusion 104 when the flashlight is correctly inserted into the charger holder 90.

Both of such diametrically opposed flats or flat pairs 119 and 121 are indicated by dotted lines at 119 and 121 in FIGS. 9 and 11.

Figure 7:
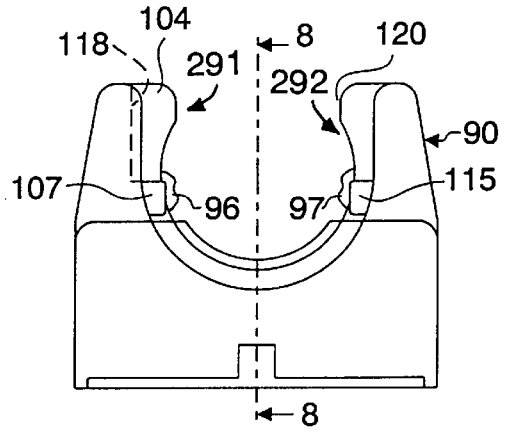
FIG. 7 is an elevation of the battery charger flashlight holder shown in FIG. 6.

The holder 90 may have a first side 291, a second side 292 opposite that first side, and a flashlight receiving opening between these first and second sides, such as shown in FIG. 7, for instance. Interacting flashlight housing and holder features may include first interacting features on the flashlight housing and said first side 291 of the holder, such as at 104/121 and 106/118, enabling insertion of said housing into that holder only in a first position of the housing relative to that holder (e.g. FIG. 9) for connection of the positive battery charging current receiving terminal to the positive battery charging current supply terminal and connection of the negative battery charging current receiving terminal to the negative battery charging current supply terminal (e.g. FIG. 10), and second interacting features (e.g. 106/117) on the housing and the second side 292 of the holder inhibiting insertion of that housing into the holder in any position of the housing relative to the holder other than the mentioned first position (e.g. FIG. 11.

According to an embodiment of the invention, the mentioned first interacting features on the flashlight housing 38 and on the first side of the holder 90 may include a protrusion on one of such housing and first side (e.g. 106/104) and a corresponding recess (e.g. 118/119 and/or 121) on the other of such housing and first side. The mentioned second interacting features on such housing and second side of the holder lack at least one recess (e.g. 119, 121, 118) on one of such flashlight housing 38 and second side of the holder 90.

According to a preferred embodiment, the flashlight housing and the holder have corresponding flashlight positioning stops, such as at 106/107 and/or 114/115. As seen in FIG. 10, the flashlight housing 38 and holder 90 have corresponding stops 106/107 and/or 114/115 positioning positive battery charging current receiving terminal at the positive battery charging current supply terminal and the negative battery charging current receiving terminal at the negative battery charging current supply terminal for an optimum battery charging position.

Embodiments of the invention, such as shown in FIGS. 6 to 11, also provide excellent retention of flashlights against forcible removal from their holders by forces of acceleration in case of crashes or other calamities.

In this respect, a known arrangement used aboard aircraft uses straps of plastic material to retain flashlights in flashlight holders which, for instance, are mounted on bulkheads inside the aircraft. In case of emergency where a light is needed, such plastic straps could be broken by yanking the flashlight from its holder. On the other hand, such straps must not be broken by forces of acceleration when there is a crash or similar calamity. In practice, such requirements tend to be at odds with each other, inasmuch as a relatively weak person may not be able to break the straps manually when an emergency light is needed, while a strong jolt or other acceleration in case of calamity may break the straps and send the flashlights flying through the interior of the aircraft, causing damage and injury. Some compromise is possible, since those plastic straps are fastened to the holder by screws. However, a tool, such as a screwdriver, would then be needed to remove the flashlight from the holder when an emergency light is needed. To locate and use tools in emergencies of this kind would, however, neither be desirable nor reliable.

The currently discussed aspect of the invention avoids such disadvantages and problems and resides in a flashlight receivable in a flashlight holder. By way of example and not by way of limitation, reference may in this respect be had to the accompanying FIGS. 6 to 11 which also disclose a flashlight-in-holder interlock having interlocking features, such as at 119, 121, 104 and 120, on the flashlight, meaning either the entire flashlight 10 or its body 38, and on its holder, such as shown at 90.

As, for instance, apparent from FIG. 9 and its above description, the interlock mentioned in the preceding paragraph is manually releasable for removal of the flashlight from the holder without screwdrivers or other tools, and also without fracture of plastic strips or other parts.

On the other hand, that interlock according to a preferred embodiment of the invention, such as the above mentioned interacting housing and holder features, retain the flashlight in its holder against forces of acceleration in calamities.

As apparent from the drawings, including FIG. 9, the flashlight-in-holder interlock is releasable for removal of the flashlight from the holder by manual movement of the flashlight in that holder, such as by manual rotary movement of the flashlight in the holder 90 from the position shown in FIG. 10 to the position shown in FIG. 9.

As for instance seen in FIG. 9, the interlock includes interacting features on the flashlight and on the holder, such as seen at 119 and 120, and at 104 and 121, which enable insertion and removal of the flashlight into and from its holder only in a first position of that flashlight relative to the holder, such as seen in FIG. 9.

Conversely, the interlock according to an embodiment of the invention blocks removal of the flashlight from its holder in a second position of that flashlight in its holder, such as seen in FIG. 10. In this respect, the drawings including FIG. 10, by way of example show congruent surfaces 124 and 125 on the flashlight and on its holder which block removal of such flashlight from its holder in a second position of such flashlight in its holder.

As mentioned above with respect to FIGS. 6 to 11, the holder 90 has a first side, a second side opposite such first side, and a flashlight receiving opening between such first and second sides. The interlock according to an embodiment of the invention includes first interacting features 104 and 121 on the flashlight and on the first side of the holder and second interacting features 119 and 120 on the flashlight and on the second side of the holder, such as seen in FIG. 9, which enable insertion and removal of the flashlight into and from its holder only in a first position of such flashlight relative to its holder. The interacting features of such interlock also include substantially congruent surfaces 124 and 125 or lack of features 119 and 121 which result in blocking of any removal of the flashlight from its holder in a second position of such flashlight in its holder, such as explained above by reference to FIG. 10.

By way of example, the interlock may include a protrusion 104 or 120 on the holder at the holder opening and a corresponding recess 121 or 120 in the flashlight, which enables insertion and removal of the flashlight into and from the holder past that protrusion in a first position of the flashlight relative to the holder. Substantially congruent surfaces 124 and 125 on the flashlight and in that opening of the holder blocking removal of the flashlight from that holder in a second position of that flashlight in that holder.

The interlock according to an embodiment of the invention may include protrusions 104 and 120 on the holder 90 at its first and second sides and corresponding recesses 119 and 121 in the flashlight enabling insertion and removal of such flashlight into and from the holder past such protrusions in a first position of the flashlight housing relative to the holder.

Interacting stops 106/107 and/or 114/115 on the flashlight and its holder 90 may stop the flashlight in a flashlight insertion and release position relative to the holder, such as seen in FIG. 9, and conversely may stop the flashlight in an alternative flashlight retaining position in its holder, such as seen in FIG. 10.

The features herein disclosed with reference to FIGS. 6 to 11 may be combined for a rechargeable flashlight. Within the scope of the invention, however, the interlocking features may alternatively be used alone without any flashlight battery recharging features. In either case, flashlights are securely retained in holders against unintended removal in all kind of calamities, including for instance strong accelerations in vehicle jolts or crashes, or jarring movement in heavy storms and earthquakes. Notwithstanding such high security feature, the interlocks according to the subject invention are manually released with ease, such as by simple angular motion of the flashlight, without the need for any tools or breakage of any retention straps or other components.

Where the interlocking feature is used without a battery charger, the flashlight may be made rotatable relative to its holder 90 in either direction 110 or 112 and the international NO symbol 109 shown in FIG. 9 does then not apply. In such a case, the main interlocking features still are the substantially congruent surfaces 124 and 125 on the flashlight and in its holder 90. Corresponding flats 119 and 121 on the flashlight and projections 104 and 120 on the holder then also serve to permit insertion and removal of the flashlight into and from its holder 90, such as illustrated in FIG. 9. However, the corresponding protrusion 106 and flat 118 are then not necessary, if rotation of the flashlight in either direction from its inserted position to a locking position, such as from the inserting position shown in FIG. 9, to the locking position shown in FIG. 10 either in the direction of arrow 110 or of arrow 112 is to be permitted, when no connection to any battery charger is to take place. In that case, it may be necessary to replace the cam 114 and stop 115 by a spring-biased detent that releasably retains the flashlight in its locked position, such as in the position shown in FIG. 10, until it is manually released by angular movement of the flashlight in either direction 110 or 112.

These are some of many solutions within the scope of the invention that make emergency and other flashlights crashworthy in many situations without impeding their easy manual removal without tools and tearing of straps or breakage of other parts.

According to an embodiment of the invention covering the structures shown in FIGS. 1 to 13, the flashlight 10 or 100 has two battery-powered and individually switched electric light sources 12 and 13. In this respect, the term "electric light source" even in the singular is not necessarily limited to a single light bulb, LED or other lamp. Rather, each electric light source may include more than one light bulb, LED or other lamp. With such possible arrangements in mind, the embodiments of the invention as illustrated in FIGS. 1 to 3 and 12 and 13 employ a first electric battery 47 for a first one of the two electric light sources, such as for the first electric light source 12 with one or more lamps, a second electric battery 48 for the second of the two electric light sources, such as for the light source 13, a first switching device 41 between the first electric battery and the first electric light source, a second switching device 42 between the second electric battery and the second electric light source, and a sequential actuator 44 coupled to such first and second switching devices.

In such an embodiment, the first electric light source 12 preferably has a power rating that is a fraction of a power rating of the second electric light source 13.

In a practical application, the first electric light source 12 may have a power rating on the order of fifty milliwatts. Additionally or alternatively, the first electric light source 12 may have a color different from the second electric light source 13.

By way of example, the first light source 12 may comprise one or more LED's or other milliwatt lamps. In this manner, a user of the flashlight may generally operate through a light source at very low battery drain, such as through partial actuation of the tailend push-button 45. At special occasions when a high light output or a strong light beam is desired, the user of the flashlight 10 or 100 may energize the stronger second light source 13, such as by further depression of the tailend push-button 45.

The term "battery" as herein employed is not limited to electrochemical devices of the primary or secondary kind, but within the scope of the invention may extend to other storage devices of electrical energy, such as ultracapacitors capable of energizing electric light sources for given applications.

This extensive disclosure will render apparent or suggest to those skilled in the art various modifications and variations within the spirit and scope of the invention.

I claim:

1. In a flashlight having two battery-powered and individually switched electric light sources, the improvement comprising in combination:

a common reflector structure for the two electric light sources including a first reflector having a first light-projecting characteristic for a first one of said two electric light sources, and a second reflector having, for the second of said two electric light sources, a second light-projecting characteristic different from the first light-projecting characteristic;

said first and second reflectors arranged side by side and having a common boundary across part of said common reflector structure.

2. A flashlight as in claim 1, wherein:

said first and second reflectors have lateral truncations at said common boundary.

3. A flashlight as in claim 1, wherein:

said boundary across part of said common reflector structure is a shield for said second reflector against light from the first electric light source.

4. A flashlight as in claim 1, wherein:

said boundary across part of said common reflector structure is a shield for either of said first and second reflectors against light from either of the second and first electric light sources, respectively.

5. A flashlight as in claim 1, wherein:

said second reflector has a larger diameter than said first reflector.

6. A flashlight as in claim 1, including:

a sequential switch for the first and second electric light sources.

7. A flashlight as in claim 1, including:

a first switching device for the first electric light source;

a second switching device for the second electric light source; and a sequential actuator coupled to said first and second switching devices.

8. A flashlight as in claim 7, wherein:

said sequential actuator includes a push-button.

9. A flashlight as in claim 1, including:

a first electric battery for the first electric light source; and a second electric battery for the second electric light source.

10. A flashlight as in claim 9, including:

a first switching device between said first electric battery and the first electric light source;

a second switching device between the second electric battery and the second electric light source; and a sequential actuator coupled to said first and second switching devices.

11. A flashlight as in claim 9, including:

a first switching device between said first electric battery and the first electric light source;

a second switching device between the second electric battery and the second electric light source; and a sequential actuator coupled to said first switching device through said first electric battery and to said second switching device through said second electric battery.

12. A flashlight as in claim 11, including:

a common electric conductor structure from the first and second electric light sources through said sequential actuator to said first and second electric batteries.

13. A flashlight as in claim 12, wherein:

said common electric conductor is biased by a spring and arranged on a mounting rod.

14. A flashlight as in claim 1, wherein:

said first electric light source has a power rating that is a fraction of a power rating of said second electric light source.

15. A flashlight as in claim 1, wherein:

said first electric light source has a power rating on the order of fifty milliwatts.

16. A flashlight as in claim 1, wherein:

said first electric light source has a color different from said second electric light source.

17. A flashlight as in claim 1, including:

a first electric battery for the first electric light source;

a second electric battery for the second electric light source;

a first switching device between said first electric battery and the first electric light source;

a second switching device between the second electric battery and the second electric light source; and electrical battery charging circuitry connectable directly to said first and second batteries when said first and second electric light sources are disconnected from said first and second batteries.

18. A flashlight as in claim 1, including:

batteries for said first and second electric light sources having a common positive terminal and a common negative terminal;

a housing for said batteries;

a positive battery charging current receiving terminal connected to said common positive terminal and a negative battery charging current receiving terminal connected to said common negative terminal in said housing;

a holder for said housing;

battery charging circuitry having in said holder a positive battery charging current supply terminal corresponding to said positive battery charging current receiving terminal, and a negative battery charging current supply terminal corresponding to said negative battery charging current receiving terminal; and interacting housing and holder features on said housing and said holder enabling insertion of said housing into said holder only for connection of said positive battery charging current terminal to said positive battery charging current supply terminal and connection of said negative battery charging current receiving terminal to said negative battery charging current supply terminal.

19. A flashlight as in claim 18, wherein:

said interacting housing and holder features include features enabling insertion of said housing into said holder only when said first and second electric light sources are disconnected from said batteries.

20. A flashlight as in claim 18, wherein:

said interacting housing and holder features include a flashlight-in-holder interlock having interlocking features on said flashlight and said holder;

said interlock being manually releasable for removal of the flashlight from the holder without tools or fracture of parts; and said interlock retaining said flashlight in said holder against forces of acceleration in calamities.

21. A flashlight as in claim 20, wherein:

said interlock is releasable for removal of the flashlight from the holder by manual movement of said flashlight in said holder.

22. A flashlight as in claim 20, wherein:

said interlock is releasable for removal of the flashlight from the holder by manual rotary movement of said flashlight in said holder.

23. In a flashlight having a switched electric light source, the improvement comprising in combination:

a battery for said electric light source having a positive terminal and a negative terminal;

a housing for said battery;

a positive battery charging current receiving terminal connected to said positive terminal and a negative battery charging current receiving terminal connected to said negative terminal in said housing;

a holder for said housing;

battery charging circuitry having in said holder a positive battery charging current supply terminal corresponding to said positive battery charging current receiving terminal, and a negative battery charging current supply terminal corresponding to said negative battery charging current receiving terminal; and interacting housing and holder features on said housing and said holder enabling insertion of said housing into said holder followed by manual movement of said housing relative to said holder for connection of said positive battery charging current receiving terminal only to said positive battery charging current supply terminal and connection of said negative battery charging current receiving terminal only to said negative battery charging current supply terminal, said interacting housing and holder features include a flashlight-in-holder interlock having interlocking features on said flashlight and said holder, said interlock being releasable for removal of the flashlight from the holder by manual rotary movement of said flashlight in said holder.

24. A flashlight as in claim 23, wherein:

said interlock being manually releasable for removal of the flashlight from the holder without tools or fracture of parts; and said interlock retaining said flashlight in said holder against forces of acceleration in calamities.

25. In a flashlight having a switched electric light source, the improvement comprising in combination:

a battery for said electric light source having a positive terminal and a negative terminal;

a housing for said battery;

a positive battery charging current receiving terminal connected to said positive terminal and a negative battery charging current receiving terminal connected to said negative terminal in said housing;

a holder for said housing;

battery charging circuitry having in said holder a positive battery charging current supply terminal corresponding to said positive battery charging current receiving terminal, and a negative battery charging current supply terminal corresponding to said negative battery charging current receiving terminal; and interacting housing and holder features on said housing and said holder enabling insertion of said housing into said holder followed by manual movement of said housing relative to said holder for connection of said positive battery charging current receiving terminal only to said positive battery charging current supply terminal and connection of said negative battery charging current receiving terminal only to said negative battery charging current supply terminal, said interacting housing and holder features include a flashlight-in-holder interlock having interlocking features on said flashlight and said holder, said interlock enabling insertion and removal of said flashlight into and from said holder only in a first position of said flashlight relative to said holder, and blocking removal of said flashlight from said holder in a second position of said flashlight in said holder.

26. A flashlight as in claim 23, wherein:

said interacting housing and holder features include features enabling insertion of said housing into said holder only when said electric light source is disconnected from said battery.

27. A flashlight as in claim 23, wherein:

said flashlight has a lamp assembly including said light source on said housing for said battery and having a light source energization enabling position and a different light source energization inhibiting position; and said holder has a lamp assembly energization enabling/inhibiting position sensor adapted to inhibit insertion of said housing into said holder when said lamp assembly is in said light source energization enabling position.

28. In a flashlight having a switched electric light source, the improvement comprising in combination:

a battery for said electric light source having a positive terminal and a negative terminal;

a housing for said battery;

a positive battery charging current receiving terminal connected to said positive terminal and a negative battery charging current receiving terminal connected to said negative terminal in said housing;

a holder for said housing, said holder having a first side, a second side opposite said first side, and a flashlight receiving opening between said first and second sides;

battery charging circuitry having in said holder a positive battery charging current supply terminal corresponding to said positive battery charging current receiving terminal, and a negative battery charging current supply terminal corresponding to said negative battery charging current receiving terminal; and interacting housing and holder features on said housing and said holder including first interacting features on said housing and said first side of the holder enabling insertion of said housing into said holder only in a first position of said housing relative to said holder for said connection of said positive battery charging current receiving terminal to said positive battery charging current supply terminal and connection of said negative battery charging current receiving terminal to said negative battery charging current supply terminal, and second interacting features on said housing and said second side of the holder inhibiting insertion of said housing into said holder in any position of said housing relative to said holder other than said first position.

29. A flashlight as in claim 28, wherein:

said first interacting features on said housing and said first side of the holder include a protrusion on one of said housing and first side and a corresponding recess on the other of said housing and first side; and said second interacting features on said housing and said second side of the holder lack at least one of said protrusion and corresponding recess on one of said housing and second side.

30. A flashlight as in claim 28, wherein:

said housing and said holder have corresponding flashlight positioning stops.

31. A flashlight as in claim 28, wherein:

said housing and said holder have corresponding stops positioning said positive battery charging current receiving terminal at said positive battery charging current supply terminal and said negative battery charging current receiving terminal at said negative battery charging current supply terminal.

32. In a flashlight having two battery-powered and individually switched electric light sources, the improvement comprising in combination:

a first electric battery for a first one of the two electric light sources;

a second electric battery for the second of said two electric light sources;

a first switching device between said first electric battery and the first electric light source;

a second switching device between the second electric battery and the second electric light source; and a sequential actuator coupled to said first and second switching devices, said sequential actuator including a push-button depressible by a first distance for actuating said first switching device and depressible by a second distance for actuating said second switching device;

said first electric light source having a power rating that is a fraction of a power rating of said second electric light source.

33. A flashlight as in claim 32, wherein:

said first electric light source has a power rating on the order of fifty milliwatts.

34. A flashlight as in claim 32, wherein:

said first electric light source has a color different from said second electric light source.

35. A flashlight as in claim 17, wherein:

said electrical battery charging circuitry is connectible directly to said first and second batteries only when said first and second light sources are disconnected from said first and second batteries.

36. In a flashlight having a switched electric light source, the improvement comprising in combination:

a battery for said electric light source having a positive terminal and a negative terminal;

a housing for said battery;

a positive battery charging current receiving terminal connected to said positive terminal and a negative battery charging current receiving terminal connected to said negative terminal in said housing;

a holder for said housing;

battery charging circuitry having in said holder a positive battery charging current supply terminal corresponding to said positive battery charging current receiving terminal, and a negative battery charging current supply terminal corresponding to said negative battery charging current receiving terminal;

interacting housing and holder features on said housing and said holder enabling insertion of said housing into said holder followed by manual movement of said housing relative to said holder for connection of said positive battery charging current receiving terminal only to said positive battery charging current supply terminal and connection of said negative battery charging current receiving terminal only to said negative battery charging current supply terminal;

said interacting housing and holder features including a flashlight-in-holder interlock having interlocking features on said flashlight and said holder; and said interlock enabling insertion and removal of said flashlight into and from said holder only in a first position of said flashlight relative to said holder, and blocking removal of said flashlight from said holder in a second position of said flashlight in said holder.

37. In a flashlight receivable in a flashlight holder, the improvement comprising in combination:

a flashlight-in-holder interlock having interacting features on the flashlight and the holder enabling insertion of said flashlight into said holder followed by manual rotary movement of said flashlight relative to said holder for locking said flashlight in said holder;

said interlock being releasable for removal of said flashlight from said holder by manual movement of said flashlight in said holder.

38. A flashlight as in claim 37, wherein:

said interacting features enable insertion of said flashlight into said holder followed by manual rotary movement of said flashlight relative to said holder.

39. A flashlight as in claim 8, wherein:

said push-button is depressible by a first distance for actuating said first switching device but not said second switching device, and is depressible by a second distance for actuating said second switching device.

40. A flashlight as in claim 8, wherein:

depression of said push-button by at least a first distance actuates said first switching device, and depression of said push-button by a second distance greater than said first distance actuates said second switching device.

41. In a flashlight, the improvement comprising in combination:

a first electric light source;

a second electric light source;

a first switching device coupled to said first electric light source;

a second switching device coupled to said second electric light source; and a sequential actuator coupled to said first and second switching devices, said sequential actuator including a push-button depressible by a first distance for actuating said first switching device and depressible by a second distance for actuating said second switching device.

42. In a flashlight having a switched electric light source, the improvement comprising in combination:

a battery for said electric light source having a positive terminal and a negative terminal;

a housing for said battery;

a positive battery charging current receiving terminal connected to said positive terminal and a negative battery charging current receiving terminal connected to said negative terminal in said housing;

a holder for said housing;

battery charging circuitry having in said holder a positive battery charging current supply terminal corresponding to said positive battery charging current receiving terminal, and a negative battery charging current supply terminal corresponding to said negative battery charging current receiving terminal; and interacting housing and holder features on said housing and said holder enabling insertion of said housing into said holder followed by manual rotary movement of said housing relative to said holder for connection of said positive battery charging current receiving terminal only to said positive battery charging current supply terminal and connection of said negative battery charging current receiving terminal only to said negative battery charging current supply terminal.

43. A flashlight as in claim 42, wherein:

said interlock is releasable for removal of the flashlight from the holder by manual rotary movement of said flashlight.

44. A flashlight as in claim 38, wherein:

said interlock includes interacting recesses and protrusions on said flashlight and said holder enabling insertion and removal of said flashlight into and from said holder in a first position of said flashlight relative to said holder, and substantially congruent surfaces on said flashlight and said holder blocking removal of said flashlight from said holder in a second position of said flashlight in said holder.

45. A flashlight as in claim 38, wherein:

said holder has a first side, a second side opposite said first side, and a flashlight receiving opening between said first and second sides; and said interlock includes first interacting features on said flashlight and said first side of the holder and second interacting features on said flashlight and said second side of the holder enabling insertion and removal of said flashlight into and from said holder in a first position of said flashlight relative to said holder, said blocking removal of said flashlight from said holder in a second position of said flashlight in said holder.

46. A flashlight as in claim 38, wherein:

said holder has a flashlight receiving opening; and said interlock includes interacting features on said flashlight and said holder enabling insertion and removal of said flashlight into and from said holder in a first position of said flashlight relative to said holder, and substantially congruent surfaces on said flashlight and in said opening of said holder blocking removal of said flashlight from said holder in a second position of said flashlight in said holder.

47. A flashlight as in claim 38, wherein:

said holder has a flashlight receiving opening; and said interlock includes a protrusion on said holder at said opening and a corresponding recess in said flashlight enabling insertion and removal of said flashlight into and from said holder past said protrusion in a first position of said flashlight relative to said holder, and substantially congruent surfaces on said flashlight and in said opening of said holder blocking removal of said flashlight from said holder in a second position of said flashlight in said holder.

48. A flashlight as in claim 38, wherein:

said holder has a first side, a second side opposite said first side, and a flashlight receiving opening between said first and second sides; and said interlock includes protrusions on said holder at said first and second sides and corresponding recesses in said flashlight enabling insertion and removal of said flashlight into and from said holder past said protrusions in a first position of said flashlight relative to said holder, and substantially congruent surfaces on said flashlight and in said opening of said holder blocking removal of said flashlight from said holder in a second position of said flashlight in said holder.

49. A flashlight as in claim 38, including:

interacting stops on said flashlight and said holder stopping said flashlight in a flashlight insertion and release position relative to said holder, and stopping said flashlight in an alternative flashlight retaining position in said holder.

50. In a flashlight receivable in a flashlight holder, the improvement comprising in combination:

a flashlight-in-holder interlock having interacting features on the flashlight and the holder enabling insertion of said flashlight into said holder followed by manual movement of said flashlight relative to said holder for locking said flashlight in said holder;

said interlock being releasable for removal of said flashlight from said holder by manual movement of said flashlight in said holder;

said interlock enabling insertion and removal of said flashlight into and from said holder only in a first position of said flashlight relative to said holder, and blocking removal of said flashlight from said holder in a second position of said flashlight in said holder.

* * * * *